US009607578B2

(12) United States Patent
Chowdhry

(10) Patent No.: US 9,607,578 B2
(45) Date of Patent: Mar. 28, 2017

(54) OUTPUT OF VIDEO CONTENT

(75) Inventor: Tripatinder Chowdhry, El Granada, CA (US)

(73) Assignee: EMPIRE TECHNOLOGY DEVELOPMENT LLC, Wilmington, DE (US)

( * ) Notice: Subject to any disclaimer, the term of this patent is extended or adjusted under 35 U.S.C. 154(b) by 273 days.

(21) Appl. No.: 13/144,401

(22) PCT Filed: Mar. 8, 2011

(86) PCT No.: PCT/US2011/027540

§ 371 (c)(1),
(2), (4) Date: Jul. 13, 2011

(87) PCT Pub. No.: WO2012/121709

PCT Pub. Date: Sep. 13, 2012

(65) Prior Publication Data

US 2012/0229518 A1 Sep. 13, 2012

(51) Int. Cl.
*G09G 5/00* (2006.01)
*G09G 5/14* (2006.01)

(52) U.S. Cl.
CPC ..... *G09G 5/14* (2013.01); *G09G 2340/045* (2013.01); *G09G 2354/00* (2013.01)

(58) Field of Classification Search
CPC .... G06F 15/16; G06F 17/30241; G06F 17/30; H04N 21/478; H04N 21/4788;
(Continued)

(56) References Cited

U.S. PATENT DOCUMENTS 5,754,873 A 5/1998 Nolan
6,466,203 B2 10/2002 Van Ee
(Continued)

FOREIGN PATENT DOCUMENTS

CN 1666193 A 9/2005
CN 101379461 A 3/2009
(Continued)

OTHER PUBLICATIONS

"For i Phone and WebOS: Pinch and Pan Gesture," accessed at http://www.youtube.com/watch?v=cXFFEFSJTpk, uploaded on Apr. 25, 2010, pp. 2.
(Continued)

*Primary Examiner* — Gregory J Tryder
*Assistant Examiner* — Kwang Lee
(74) *Attorney, Agent, or Firm* — Moritt Hock & Hamroff LLP; Steven S. Rubin, Esq.

(57) ABSTRACT

Technologies are generally described for systems and methods effective to output video content. In some examples, a content output device may be effective to receive a first request for first video content including a first identifier and a first category. The device may receive a zoom selection for the first video content including a first zoom level assigned to the first video content. The selection may be based on the first identifier or the first category. The device may store the zoom selection in a memory and receive a second request for second video content including a second identifier and a second category. The device may analyze the memory to determine a second zoom level for the second video content based on the first zoom level and the first identifier or the first category. The device may output the second video content at the second zoom level.

10 Claims, 4 Drawing Sheets

(58) Field of Classification Search
CPC ..... G01C 21/32; G01C 21/367; G06T 17/05; G06T 11/20; G06T 3/40; G06K 9/46; G06K 9/00006; G09B 29/006; G09B 29/106; G06Q 30/02; G10L 15/22; H04M 1/72561; H04M 3/493; G03B 35/06
USPC ..... 345/660
See application file for complete search history.

(56) References Cited

U.S. PATENT DOCUMENTS

| | | | | |
|---|---|---|---|---|
| 7,479,949 | B2 | 1/2009 | Jobs et al. | |
| 2005/0193053 | A1 | 9/2005 | Kendall et al. | |
| 2006/0156228 | A1* | 7/2006 | Gallo et al. | 715/523 |
| 2007/0150829 | A1* | 6/2007 | Eschbach et al. | 715/781 |
| 2007/0152984 | A1 | 7/2007 | Ording et al. | |
| 2009/0024945 | A1* | 1/2009 | Balassanian | 715/769 |
| 2010/0146378 | A1 | 6/2010 | Bank et al. | |
| 2010/0156806 | A1 | 6/2010 | Stallings | |
| 2010/0315438 | A1 | 12/2010 | Horodezky et al. | |
| 2011/0209102 | A1* | 8/2011 | Hinckley et al. | 715/863 |
| 2012/0011568 | A1* | 1/2012 | Tahan | 726/4 |
| 2012/0050332 | A1* | 3/2012 | Nikara et al. | 345/660 |

FOREIGN PATENT DOCUMENTS

| | | | |
|---|---|---|---|
| JP | 2003333514 | | 11/2003 |
| JP | 2009522669 | A | 6/2009 |
| JP | 4452430 | B2 | 4/2010 |
| WO | 2007079425 | A2 | 7/2007 |
| WO | 2012121709 | A1 | 9/2012 |

OTHER PUBLICATIONS

Anmtton, M., "160,000 Android Phones Sold Per Day Michael Anmtton," accessed at http://web.archive.org/web/20110227045709/http://techcrunch.com/2010/06/23/160000-android-phones-sold-per-day, posted on Jun. 23, 2010, pp. 2.

Bederson, The Promise of Zoomable User Interfaces; Human-Computer Interaction Lab, www.cs.umd.edu/bederson; (2009) 1-11.

"iPhone"; http://en.wikipedia.org/wiki/IPhone; retrieved from Wikipedia on Jul. 13, 2011.

PCT International Search Report PCT/ISA/210 for PCT/US2011/27540 dated May 5, 2011.

http://www.ghacks.net/2009/02/24/firefox-3-site-specific-zoom/ <http://www.ghacks.net/2009/02/24/firefox-3-site-specific-zoom/>; retrieved Jul. 13, 2011.

http://urandom.ca/nosquint/<http://urandom.ca/nosquint/>; retrieved Jul. 13, 2011.

https://developer.mozilla.org/en/Mobile/Viewport_meta_tag <https://developer.mozilla.org/en/Mobile/Viewport_meta_tag> ; retrieved Jul. 13, 2011.

http://www.ibm.com/developerworks/opensource/library/os-androidiphone1/; retrieved Jul. 13, 2011.

* cited by examiner

OUTPUT OF VIDEO CONTENT

CROSS REFERENCE TO RELATED APPLICATION

This application is a U.S. National Stage filing under 35 U.S.C. § 371 of International Application No. PCT/US2011/027540 filed Mar. 8, 2011, the entirety of which is hereby incorporated by reference.

BACKGROUND

Unless otherwise indicated herein, the materials described in this section are not prior art to the claims in this application and are not admitted to be prior art by inclusion in this section.

Video content, such as video information, electronic books, Internet publications, outputs of mobile device applications, software effective to display video, etc. may be output by different content output devices. For example, content may be output to a user through a computer, mobile phone, smart phone, super phone, augmented reality device, etc. In general, these types of content output devices create waves that are discernible by a human.

SUMMARY

In one example, a method for outputting video content on a display of a content output device is generally described. The method may include receiving, at the content output device, a first request for first video content, the first video content including a first identifier and a first category. The method may include receiving, at the content output device, a zoom selection for the first video content. The zoom selection may include a first zoom level assigned to the first video content. The first zoom level may be based on at least one of the first identifier or the first category. The method may include storing the zoom selection in a memory. The method may include receiving, at the content output device, a second request for second video content, the second video content including a second identifier and a second category. The method may include analyzing, by the content output device, the memory to determine a second zoom level for the second video content based on the first zoom level, and based on at least one of the first identifier or the first category. The method may include controlling the display to output the second video content at the second zoom level.

In another example, a content output device effective to output video content is generally described. In some examples, the content output device may include a memory, a display, and a processor in communication with the memory and the display. The processor may be effective to receive a first request for first video content, the first video content including a first identifier and a first category. The processor may be effective to receive a zoom selection for the first video content. The zoom selection may include a first zoom level assigned to the first video content. The first zoom level may be based on at least one of the first identifier or the first category. The processor may be effective to store the zoom selection in a memory. The processor may be effective to receive a second request for second video content, the second video content including a second identifier and a second category. The processor may be effective to analyze the memory to determine a second zoom level for the second video content based on the first zoom level, and based on at least one of the first identifier or the first category. The processor may be effective to control the display to output the second video content at the second zoom level.

In another example, a computer storage medium having computer-executable instructions stored thereon which, when executed by a computer, adapt the computer to perform the method of outputting video content on a display of a content output device is generally described. In some examples, the method may include receiving, at the content output device, a first request for first video content, the first video content including a first identifier and a first category. The method may include receiving, at the content output device, a zoom selection for the first video content. The zoom selection may include a first zoom level assigned to the first video content. The first zoom level may be based on at least one of the first identifier or the first category. The method may include storing the zoom selection in a memory. The method may include receiving, at the content output device, a second request for second video content, the second video content including a second identifier and a second category. The method may include analyzing, by the content output device, the memory to determine a second zoom level for the second video content based on the first zoom level, and based on at least one of the first identifier or the first category. The method may include controlling the display to output the second video content at the second zoom level.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
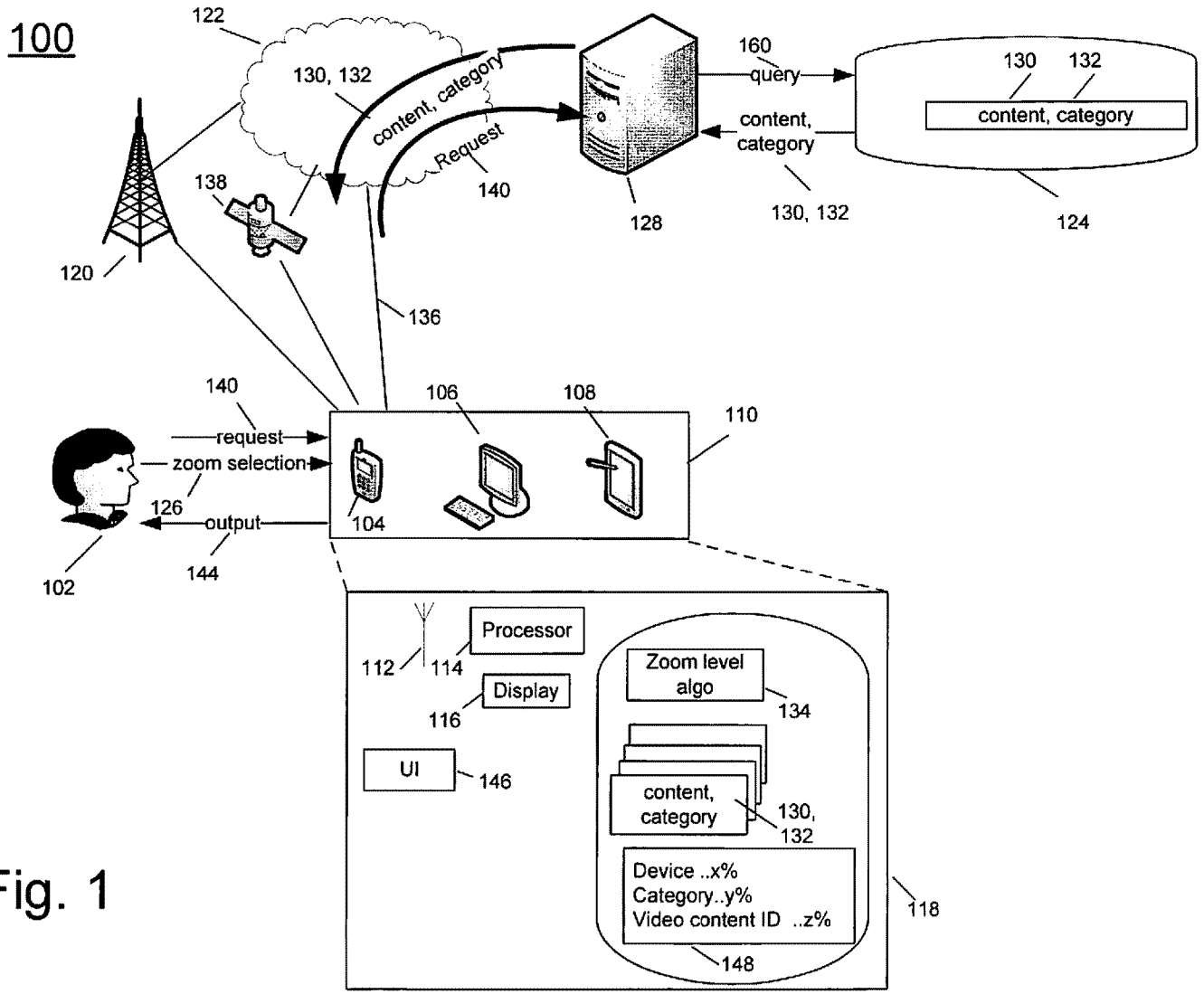
FIG. 1 illustrates some example systems that can be utilized to output video content.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This disclosure is generally drawn, inter alia, to methods, apparatus, systems, devices, and computer program products that can be utilized to output video content.

Briefly stated, technologies are generally described for systems and methods effective to output video content. In some examples, a content output device may be effective to receive a first request for first video content including a first identifier and a first category. The device may receive a zoom selection for the first video content including a first zoom level assigned to the first video content. The selection may be based on the first identifier or the first category. The device may store the zoom selection in a memory and receive a second request for second video content including a second identifier and a second category. The device may analyze the memory to determine a second zoom level for the second video content based on the first zoom level and the first identifier or the first category. The device may output the second video content at the second zoom level.

FIG. 1 illustrates some example systems that can be utilized to output video content arranged in accordance with at least some embodiments described herein. As discussed in more detail below, in some examples, a system 100 may include a content output device 110, and/or a video content processor 128 in communication through a network 122 such as the Internet. In some examples, content output device 110 may be a mobile phone 104, such as a smart phone or a super phone, a computer 106, a tablet computer 108 or any device or mobile device with a processor capable of outputting video content. Content output device 110 may include a network interface 112 such as an antenna, a display 116, a memory 118, and/or a user interface 146 all in communication with a processor 114. In an example, user interface 146 may be a touch screen interface adapted to allow a user to select a zoom level of video content such as by a pinching and/or releasing motion. Network interface 112 may be configured to enable wired or wireless communications to network 122 such as through a cell tower 120, satellite 138 or cable 136. Memory 118 may be configured to store a zoom level algorithm 134, video content 130 and associated category 132, and/or a zoom table 148 as discussed in more detail below.

In some examples, video content processor 128 may be in communication with a memory 124. Memory 124 may be adapted to store video content 130 and/or an associated category 132. Video content processor 128 may be configured to send video content 130 to content output device 110. Video content 130 may be assigned to a category by a content author that stored video content 130 in memory 124. In some examples, video content processor 128 may be a web server configured to send video content 130 in the form of a web page. In these examples, category 132 may relate to an amount of content on a particular page as selected by the content author. In some examples, video content processor 128 may host a mobile device application or "app" store such as may be used by a mobile device like a mobile phone, or tablet computer. In these examples, video content 130 may be an output of the mobile device application and category 132 may relate to a type of application such as work productivity, games, social media, etc. In some examples, processor 114 may act as an application launcher when video content 130 is an application.

In an example, content output device 110 may be configured to receive a request from a user 102 for first video content 130. Content output device 110 may be configured to send request 140 over network 122 to video content processor 128. Video content processor 128 may be configured to send a query 160, based on request 140, to memory 124. In response to query 160, memory 124 may send video content 130 and the associated category 132 to video content processor 128. Video content processor 128 may be configured to send video content 130 and category 132 to content output device 110. For example, first video content 130 may be a web page or output of a mobile device application.

Processor 114 may be configured to receive a zoom selection 126 from user 102. Zoom selection 126 may indicate a desired zoom level for first video content 130. Zoom selection 126 may be, for example, based on a user performing a pinching motion on user interface 146. In an example, zoom selection 126 may assign a zoom level to video content associated with a particular category. Zoom level algorithm 134 may be adapted such that second video content subsequently received by content output device 110 with the same category as the first video content may be assigned the same zoom level as the first video content. In an example, zoom selection 126 may assign a zoom level to an identifier associated with the first video content. For example, the identifier may be "XYZ app". Zoom level algorithm 134 may be adapted such that second video content subsequently received by content output device 110 with the same identifier may be assigned the same zoom level as the first video content.

Processor 114 of content output device 110 may be configured to control display 116 to output video content 130 at a zoom level assigned by zoom level algorithm 134. In an example, zoom level algorithm 134 may be adapted to assign a zoom level for particular video content to be output on output device 110 regardless of the particular category or the particular video content itself. These examples may occur prior to content output device 110 receiving zoom selection 126 or where categories and identifiers in received zoom selection 126 are not the same as categories or identifiers of the particular video content to be output. In some examples, depending on a size of display 116, the zoom level assigned by zoom level algorithm 134 may have a different value. For example, if content output device 110 is a 22 inch monitor, the zoom level may be smaller than if content output device 110 is a mobile phone with a 4.5 inch display.

Zoom level algorithm 134 may be adapted to assign a zoom level for video content associated with a particular category. For example, zoom selection 126 received from user 102 may include an indication of a desired zoom level for first video content associated with a particular category. Zoom level algorithm 134 may be adapted to assign the same zoom level for second received video content 130 associated with the same category as the first video content.

Zoom level algorithm 134 may be adapted to assign a zoom level for the particular first video content 130 identified by an identifier. For example, zoom selection 126 may include an indication of a desired zoom level for the particular first video content based on an identifier. Zoom level algorithm 134 may be adapted to assign the same zoom level for second received video content 130 with the same identifier as the first video content.

In an example, processor 114 may be configured to control display 116 to output video content 130 at a default device zoom level based on content output device 110. The system zoom level may be used, for example, the first time a user uses device 110 or the first time the particular content is output by device 110. Based on zoom selection 126, user 102 may override the default system zoom level.

After zoom selection 126, relating to a category or video content identifier, is received by output device 110 for first video content, processor 114 may be configured to store zoom selection 126 in a zoom table 148. In an example, zoom levels assigned for content output device, category, and video content identifier may be stored in zoom table 148. In examples where processor 114 receives a subsequent request 140 to display second video content, processor 114 may be configured to analyze table 148 to determine a zoom level for the second video content based on zoom level algorithm 134.

In an example, user 102 may assign a zoom level of 10% for first video content assigned to category JFK. In examples where user 102 makes a subsequent request to output second video content 130, processor 114 may be configured to determine a category associated with the second video content. If the category associated with the second video content is stored in zoom table 148, processor 114 may be configured to control display 116 to output the second video content at the stored zoom level. In a particular example, if category 132 relates to electronic books, once user 102 assigns a zoom level for the category electronic books in zoom selection 126, processor 114 may be configured to control display 116 to output subsequently requested electronic books at the same zoom level.

In examples when processor 114 is configured to receive request 140 for output of particular video content 130, processor 114 may be configured to request and received video content 130 and associated category 132 from video content processor 128. Processor 114 may be configured to analyze zoom table 148. If zoom table 148 includes a first zoom level assigned for the identifier of the particular video content, processor 114 may be configured to control display 116 to output the particular video content at the first zoom level. If zoom table 148 does not have a zoom level assigned for the identifier of the particular video content, processor 114 may be configured to analyze zoom table 148 to determine if a second zoom level is assigned for the category associated with the particular video content. If zoom table 148 has a second zoom level assigned for the category associated with the particular video content, then processor 114 may be configured to control display 116 to output the particular video content at the second zoom level. If zoom table 148 does not have a zoom level assigned for the category associated with the particular data, then processor 114 may be configured to control display 116 to display the particular video content at the device zoom level.

As mentioned above, category 132 may be assigned by a content author. For example, category 132 may be assigned as work productivity or a game in examples where video content 130 is a mobile device application. In examples where video content 130 is a web page, category 132 may be assigned as a "content page", or "sub-site" or using any other taxonomy desired by a content author. For example, a content author can be provided with guidelines as to how to assign a category based on particular video content. In the web page example, a "home page" category may be a web page corresponding to a particular URL (Uniform Resource Locator) and a "sub-site" category may be a web page with limited content, as determined by the content author, and includes links to other web pages. A "content" page category may have significant content for reading, again as defined by the content author. The content author can define the categories to associate with each page of a web site, such as in meta-tags on the respective pages, and then user 102 can define the zoom level for each of those categories.

Zoom level algorithm 134 may be stored as part of an operating system of content output device 110. In these examples, zoom level algorithm 134 may provide kernel level calls to the operating system. Zoom level algorithm 134 may be stored on top of the operating system of output device 110 in a user library or application programming interface (API) library call.

Among other potential benefits, a system in accordance with the disclosure may be used to provide a user with a better experience viewing video content. For example, instead of repeatedly zooming in and zooming out of displayed content, the user can define a zoom level that the user desires for categories of content. As different categories may have different levels of text or graphical information, the user may define a zoom level that works better and is more customized for the particular user. The user need not be limited to a zoom level defined by a content author. Applications within each category may have similar levels of graphic and/or text and may benefit from being output at the same zoom level. In examples where a system includes a mobile device, a system in accordance with the disclosure may optimize the ability view video content where zoom selections may be performed by a pinching motion of the user's fingers. The user need not necessarily adjust a zoom level every time the user launches a new application, relaunches an application, launches a web browser or starts a new application session.

Figure 2:
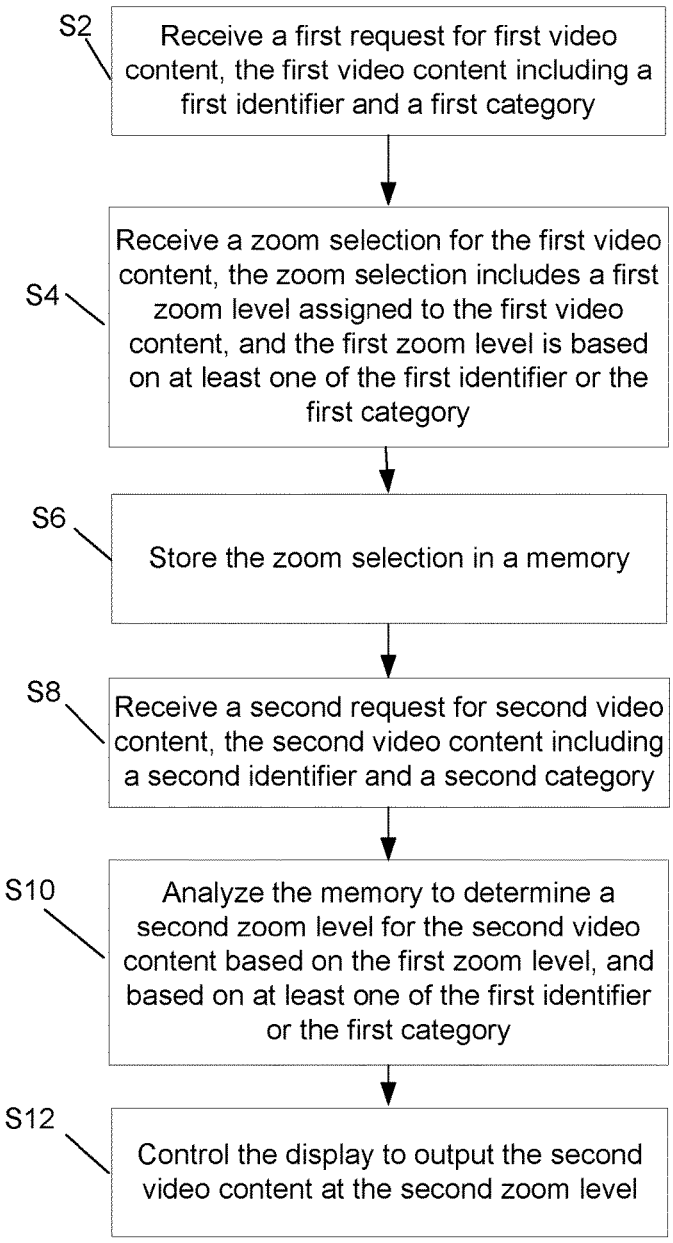
FIG. 2 depicts a flow diagram for example processes that can be utilized to output video content.

FIG. 2 depicts a flow diagram for example processes that can be utilized to output video content arranged in accordance with at least some embodiments described herein. The process in FIG. 2 could be implemented using, for example, system 100 discussed above. An example process may include one or more operations, actions, or functions as illustrated by one or more of blocks S2, S4, S6, S8, S10 and/or S12. Although illustrated as discrete blocks, various blocks may be divided into additional blocks, combined into fewer blocks, or eliminated, depending on the desired implementation. Processing may begin at block S2.

At block S2, a content output device may be configured to receive a first request for first video content. The first video content may include a first identifier and a first category. Processing may continue from block S2 to block S4.

At block S4, the content output device may be configured to receive a zoom selection for the first video content. The zoom selection may include a first zoom level assigned to the first video content. The first zoom level may be based on at least one of the first identifier or the first category. Processing may continue from block S4 to block S6.

At block S6, the content output device may be configured to store the zoom selection in a memory. Processing may continue from block S6 to block S8.

At block S8, the content output device may be configured to receive a second request for second video content. The second video content may include a second identifier and a second category. Processing may continue from block S8 to block S10.

At block S10, the content output device may be configured to analyze the memory to determine a second zoom level for the second video content based on the first zoom level, and based on at least one of the first identifier or the first category. Processing may continue from block S10 to block S12. At block S12, the content output device may be configured to control the display to output the second video content at the second zoom level.

Figure 3:
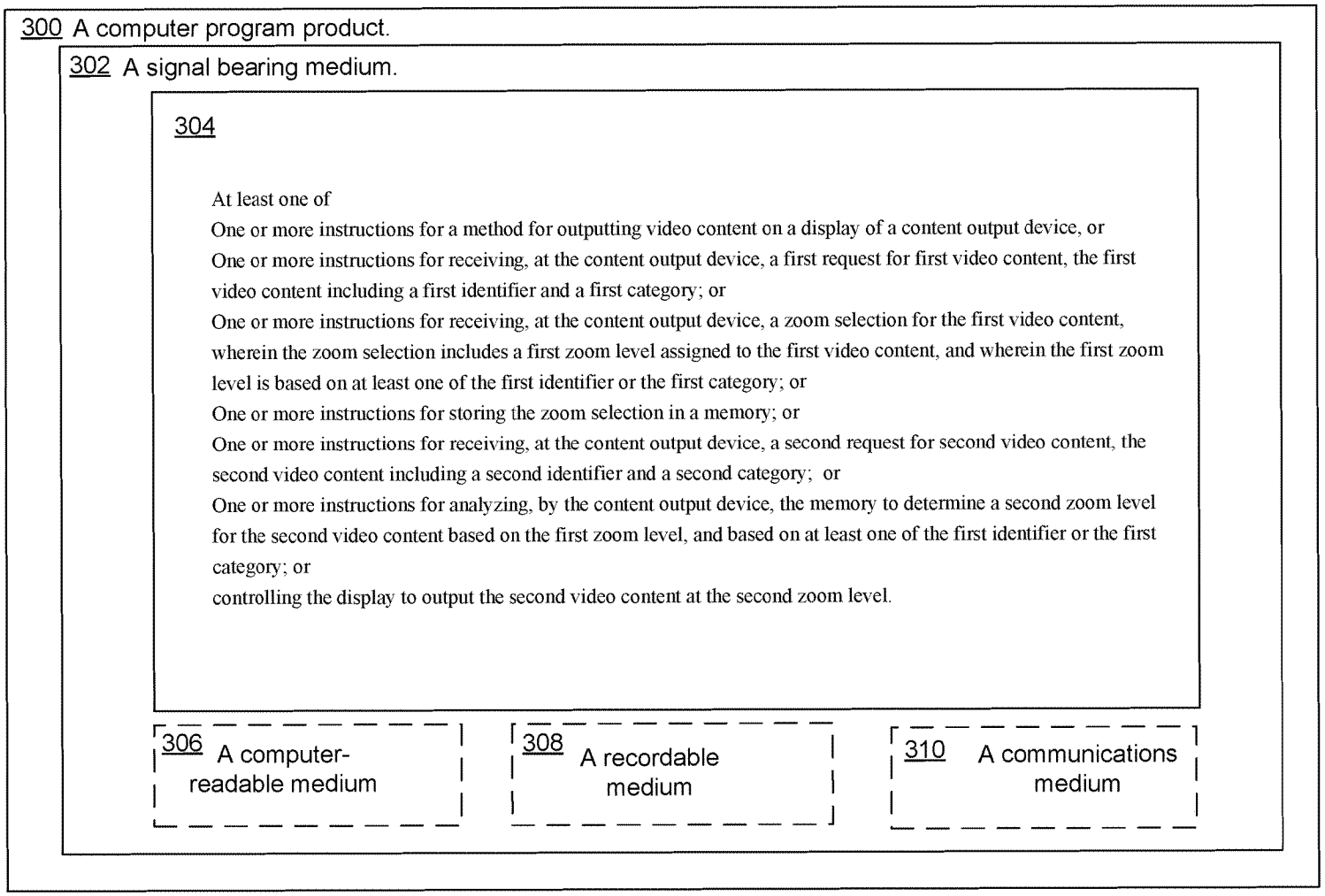
FIG. 3 illustrates a computer program product that can be utilized to output video content.

FIG. 3 illustrates a computer program product 300 that can be utilized to output video content in accordance with at least some embodiments described herein. Computer program product 300 may include a signal bearing medium 302. Signal bearing medium 302 may include one or more instructions 304 that, when executed by, for example, a processor, may provide the functionality described above with respect to FIGS. 1-2. Thus, for example, referring to system 100, content output device 110 may undertake one or more of the blocks shown in FIG. 3 in response to instructions 304 conveyed to the system 100 by signal bearing medium 302.

In some implementations, signal bearing medium 302 may encompass a computer-readable medium 306, such as, but not limited to, a hard disk drive, a Compact Disc (CD), a Digital Video Disk (DVD), a digital tape, memory, etc. In some implementations, signal bearing medium 302 may encompass a recordable medium 308, such as, but not limited to, memory, read/write (R/W) CDs, R/W DVDs, etc. In some implementations, signal bearing medium 302 may encompass a communications medium 310, such as, but not limited to, a digital and/or an analog communication medium (e.g., a fiber optic cable, a waveguide, a wired communications link, a wireless communication link, etc.). Thus, for example, computer program product 300 may be conveyed to one or more modules of the system 100 by an RF signal bearing medium 302, where the signal bearing medium 302 is conveyed by a wireless communications medium 310 (e.g., a wireless communications medium conforming with the IEEE 802.11 standard).

Figure 4:
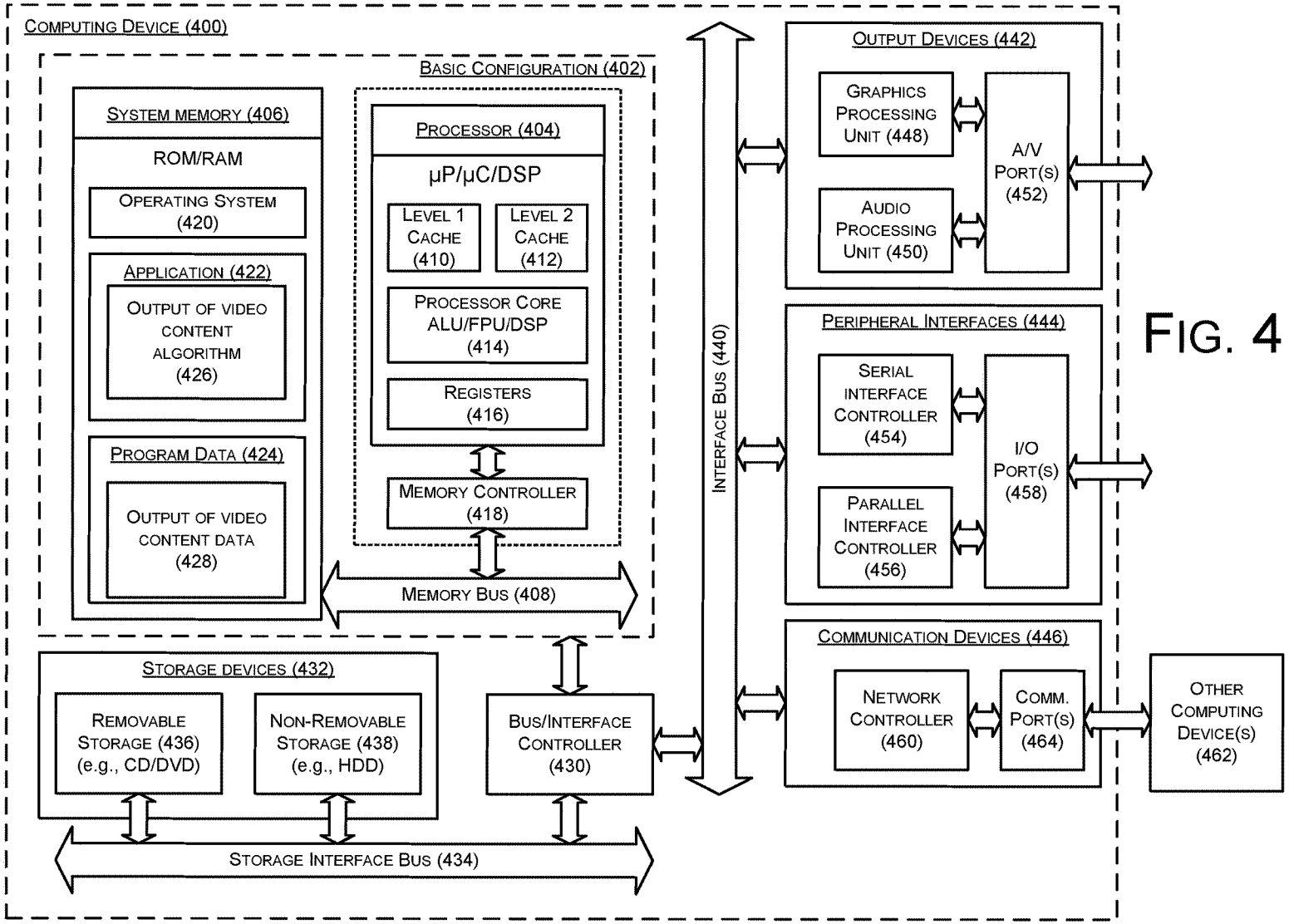
FIG. 4 is a block diagram illustrating an example computing device that can be utilized to output video content, all arranged in accordance with at least some embodiments described herein.

FIG. 4 is a block diagram illustrating an example computing device 400 that can be utilized to output video content in accordance with at least some embodiments described herein. In a very basic configuration 402, computing device 400 typically includes one or more processors 404 and a system memory 406. A memory bus 408 may be used for communicating between processor 404 and system memory 406.

Depending on the desired configuration, processor 404 may be of any type including but not limited to a microprocessor (μP), a microcontroller (μC), a digital signal processor (DSP), or any combination thereof. Processor 404 may include one more levels of caching, such as a level one cache 410 and a level two cache 412, a processor core 414, and registers 416. An example processor core 414 may include an arithmetic logic unit (ALU), a floating point unit (FPU), a digital signal processing core (DSP Core), or any combination thereof. An example memory controller 418 may also be used with processor 404, or in some implementations memory controller 418 may be an internal part of processor 404.

Depending on the desired configuration, system memory 406 may be of any type including but not limited to volatile memory (such as RAM), non-volatile memory (such as ROM, flash memory, etc.) or any combination thereof. System memory 406 may include an operating system 420, one or more applications 422, and program data 424.

Application 422 may include an output of video content algorithm 426 that is arranged to perform the functions as described herein including those described previously with respect to FIGS. 1-3. Program data 424 may include output of video content data 428 that may be useful for an output of video content algorithm as is described herein. In some embodiments, application 422 may be arranged to operate with program data 424 on operating system 420 such that outputting content from multiple devices may be provided. This described basic configuration 402 is illustrated in FIG. 4 by those components within the inner dashed line.

Computing device 400 may have additional features or functionality, and additional interfaces to facilitate communications between basic configuration 402 and any required devices and interfaces. For example, a bus/interface controller 430 may be used to facilitate communications between basic configuration 402 and one or more data storage devices 432 via a storage interface bus 434. Data storage devices 432 may be removable storage devices 436, non-removable storage devices 438, or a combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Example computer storage media may include volatile and nonvolatile, removable and non-removable media implemented in any method or technology for storage of information, such as computer readable instructions, data structures, program modules, or other data.

System memory 406, removable storage devices 436 and non-removable storage devices 438 are examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which may be used to store the desired information and which may be accessed by computing device 400. Any such computer storage media may be part of computing device 400.

Computing device 400 may also include an interface bus 440 for facilitating communication from various interface devices (e.g., output devices 442, peripheral interfaces 444, and communication devices 446) to basic configuration 402 via bus/interface controller 430. Example output devices 442 include a graphics processing unit 448 and an audio processing unit 450, which may be configured to communicate to various external devices such as a display or speakers via one or more A/V ports 452. Example peripheral interfaces 444 include a serial interface controller 454 or a parallel interface controller 456, which may be configured to communicate with external devices such as input devices (e.g., keyboard, mouse, pen, voice input device, touch input device, etc.) or other peripheral devices (e.g., printer, scanner, etc.) via one or more I/O ports 458. An example communication device 446 includes a network controller 460, which may be arranged to facilitate communications with one or more other computing devices 462 over a network communication link via one or more communication ports 464.

The network communication link may be one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

Computing device 400 may be implemented as a portion of a small-form factor portable (or mobile) electronic device such as a cell phone, a personal data assistant (FDA), a personal media player device, a wireless web-watch device, a personal headset device, an application specific device, or a hybrid device that include any of the above functions. Computing device 400 may also be implemented as a personal computer including both laptop computer and non-laptop computer configurations.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method to output video content on a display of a content output device, the method comprising:

receiving, at the content output device, a first request for first video content, the first video content including a first identifier related to the first video content and a first category, wherein the first category categorizes the first video content by a first level of graphic and/or text information in the first video content;

receiving, at the content output device, a zoom selection for the first video content, wherein the zoom selection includes a first zoom level assigned to the first video content, and wherein the first zoom level includes a zoom level percentage of the first video content to be output on the display by the content output device and is based on at least one of the first identifier or the first category;

storing the zoom selection in a memory;

receiving, at the content output device, a second request for second video content, the second video content being different than the first video content, and the second video content including a second identifier related to the second video content and a second category, wherein the second category categorizes the second video content by a second level of graphic and/or text information in the second video content;

analyzing, by the content output device, the memory to determine that the second video content to be output on the display is at a first size and the second video content is not assigned a zoom level in the memory;

assigning the second video content to the first zoom level when the first category is the same as the second category and/or when the first identifier is the same as the second identifier;

assigning the second video content to the first zoom level when the first identifier is not the same as the second identifier and the first category is the same as the second category;

assigning the second video content to a second zoom level based on the display of the content output device when the first identifier is not the same as the second identifier and when the first category is not the same as the second category; and outputting the second video content on the display at the first zoom level or the second zoom level, wherein the second video content output on the display by the content output device at the first zoom level or the second zoom level, is output at a second size, different from the first size.

2. The method as recited in claim 1, wherein:

the first and second video content are first and second outputs from first and second mobile device applications, wherein the first mobile device application includes the first identifier and the first category, and the second mobile device application includes the second identifier and the second category; and the method further comprises:

controlling the display to output the second video content of the second mobile device application at the first zoom level.

3. The method as recited in claim 1, wherein:

the first video content is a first web page; and the second video content is a second web page.

4. The method as recited in claim 3, wherein:

the first category further relates to an amount of content on the first web page; and the second category further relates to an amount of content on the second web page.

5. The method as recited in claim 1, wherein receiving the zoom selection includes receiving a pinching motion on a touch screen user interface of the content output device.

6. A content output device, comprising:

a memory;

a display; and a processor in communication with the memory and the display, wherein the processor is effective to:

receive a first request for first video content, the first video content including a first identifier related to the first video content and a first category, wherein the first category categorizes the first video content by a first level of graphic and/or text information in the first video content;

receive a zoom selection for the first video content, wherein the zoom selection includes a first zoom level assigned to the first video content, and wherein the first zoom level includes a zoom level percentage of the first video content to be output on the display by the content output device and is based on at least one of the first identifier or the first category;

store the zoom selection in the memory;

receive a second request for second video content, the second video content being different from the first video content, the second video content including a second identifier related to the second video content and a second category, wherein the second category categorizes the second video content by a second level of graphic and/or text information in the second video content;

analyze the memory to determine that the second video content to be output on the display is at a first size and the second video content is not assigned a zoom level in the memory;

assign the second video content to the first zoom level when the first category is the same as the second category and/or when the first identifier is the same as the second identifier;

assign the second video content to the first zoom level when the first identifier is not the same as the second identifier and the first category is the same as the second category;

assign the second video content a second zoom level based on the display of the content output device when the first identifier is not the same as the second identifier and when the first category is not the same as the second category; and output the second video content on the display at the first zoom level or the second zoom level, wherein the second video content output on the display by the content output device at the first zoom level or the second zoom level, is output at a second size, different from the first size.

7. The content output device as recited in claim 6, wherein:

the first and second video content are first and second outputs from first and second mobile device applications, wherein the first mobile device application includes the first identifier and the first category, and the second mobile device application includes the second identifier and the second category; and the processor is effective to control the display to output the second video content of the second mobile device application at the first zoom level.

8. The content output device as recited in claim 6, wherein:

the first video content is a first web page; and the second video content is a second web page;

the first category further relates to an amount of content on the first web page; and the second category further relates to an amount of content on the second web page.

9. The content output device as recited in claim 6, further comprising:

a touch screen user interface in communication with the processor; and wherein to receive the zoom selection, the processor is effective to detect a pinching motion on the touch screen user interface.

10. A non-transitory computer storage medium having computer-executable instructions stored thereon which, when executed by a computer, adapt the computer to perform a method, the method comprising:

receiving, at a content output device, a first request for first video content, the first video content including a first identifier related to the first video content and a first category, wherein the first category categorizes the first video content by a first level of graphic and/or text information in the first video content;

receiving, at the content output device, a zoom selection for the first video content, wherein the zoom selection includes a first zoom level assigned to the first video content, and wherein the first zoom level includes a zoom level percentage of the first video content to be output on a display by the content output device and is based on at least one of the first identifier or the first category;

storing the zoom selection in a memory;

receiving, at the content output device, a second request for second video content, the second video content being different from the first video content, the second video content including a second identifier related to the second video content and a second category, wherein the second category categorizes the second video content by a second level of graphic and/or text information in the second video content;

analyzing, by the content output device, the memory to determine that the second video content to be output on the display is at a first size and the second video content is not assigned a zoom level in the memory;

assigning the second video content to the first zoom level when the first category is the same as the second category and/or when the first identifier is the same as the second identifier;

assigning the second video content to the first zoom level when the first identifier is not the same as the second identifier and the first category is the same as the second category;

assigning the second video content to a second zoom level based on the display of the content output device when the first identifier is not the same as the second identifier and when the first category is not the same as the second category; and outputting the second video content on the display at the first zoom level or the second zoom level, wherein the second video content output on the display by the content output device at the first zoom level or the second zoom level, is output at a second size, different from the first size.

* * * * *